US005788112A

United States Patent [19]

Bacon et al.

[11] Patent Number: 5,788,112

[45] Date of Patent: *Aug. 4, 1998

[54] CONTAINER AND END CLOSURE ADAPTED FOR EVACUATING AND BACK-FLUSHING OF GASES DURING CLOSING

[75] Inventors: John Ellis Bacon; Teddy M. Westphal, both of Hartsville, S.C.

[73] Assignee: Sonoco Products Company, Hartsville, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 646,592

[22] Filed: May 8, 1996

[51] Int. Cl.[6] ..... B65D 8/12; B65D 8/20; B65D 51/16

[52] U.S. Cl. ..... 220/611; 220/366.1; 220/612; 220/619; 220/623

[58] Field of Search ..... 220/366.1, 360, 220/364, 611, 612, 614, 619, 623, 913, 359

[56] References Cited

U.S. PATENT DOCUMENTS

| | | | |
|---|---|---|---|
| 1,689,641 | 10/1928 | Pickles . | |
| 1,766,173 | 6/1930 | Hills . | |
| 1,843,918 | 2/1932 | Cornell . | |
| 2,154,349 | 4/1939 | O'Brien | 220/612 X |
| 2,321,408 | 6/1943 | Mills et al. . | |
| 2,558,723 | 7/1951 | Ayres . | |
| 2,629,421 | 2/1953 | Ayres . | |
| 2,986,319 | 5/1961 | Bierman et al. | 220/614 X |
| 3,221,922 | 12/1965 | Smith . | |
| 3,386,615 | 6/1968 | Jacobsen . | |
| 4,163,504 | 8/1979 | Elser . | |
| 4,717,575 | 1/1988 | Larroche . | |

FOREIGN PATENT DOCUMENTS

| | | | |
|---|---|---|---|
| 249033 | 1/1964 | Australia . | |
| 0692696 | 8/1964 | Canada | 220/612 |
| 1 337 956 | 11/1973 | United Kingdom . | |

*Primary Examiner*—Allan N. Shoap
*Assistant Examiner*—Niki M. Kopsidas
*Attorney, Agent, or Firm*—Bell Seltzer IP Group Alston & Bird LLP

[57] ABSTRACT

A container and end adapted for closing and sealing the container with a double-seaming operation is provided which permits evacuating and back-flushing of gases out of and into the container while the end is in a seated and unseamed position on the container during the closing operation. The end includes a central circular panel, a chuck wall surrounding an outer periphery of the central panel and extending radially outwardly and upwardly from the central panel and a crown seaming panel surrounding the chuck wall and extending radially outwardly from the chuck wall and having an outer curled end for being double-seamed with a flanged upper end portion of the container for closing of the container. The end preferably includes sealing compound positioned on an inside surface of the chuck wall and the crown seaming panel. Separate projections are formed in the chuck wall and in the crown seaming panel of the end and extend inwardly and radially of the chuck wall and crown seaming panel, respectively, and are spaced around the chuck wall and the crown seaming panel for engaging the flanged upper end of the container being closed for forming gas channels between the respective projections and between the flanged upper end of the container and the chuck wall and the crown seaming panel of the end when such end is in a seated and unseamed position on the container during closing and prior to completion of the double-seaming operation.

10 Claims, 3 Drawing Sheets

CONTAINER AND END CLOSURE ADAPTED FOR EVACUATING AND BACK-FLUSHING OF GASES DURING CLOSING

FIELD OF THE INVENTION

This invention relates to a container and end for closing and sealing the container with a double seaming operation and being adapted for permitting evacuating and back-flushing of gases out of and into the container while the end is in a seated and unseamed position on the container during the closing operation.

BACKGROUND OF THE INVENTION

Heretofore, it has been conventional practice in the packaging field to manufacture metallic containers or cans for storage of comestibles, beverages and other various products which include a cylindrical open-end container body fabricated from sheet metal and having a metal end closure which is double-seamed onto an outwardly flanged end portion of the container body at one or both ends and which includes a sealing compound between the metal end closure and the flanged end portion of the container body. Such closing operation of the end on the container utilizing double-seaming has been a favored form of assembling containers and end closures since it is readily adapted to production line manufacturing capabilities and at the same time providing a reliable hermetic seal capable of withstanding substantial pressure differentials which may exist, or be encountered, between the ambient atmosphere and the interior confines of the filled container during processing of the container's contents or during subsequent shipping and storing.

During the closing operation of the end on the container, it is often desired to evacuate gases from the container with the contents therein and back-fill the container with other gases, i.e. evacuating oxygen and back-filling with nitrogen. In order to be able to carry out this evacuating and back-filling of gases, it is necessary when the end is positioned on the container that there be provided gas channels between the end and the flanged end portion of the container and that premature sealing between the end and the container by the sealing compound be avoided at the gas channels. Heretofore, this has been primarily accomplished by utilizing "stand-off beads" produced by forming a rounded dimple in the upper surface of the crown seaming panel, i.e. that portion of the end which is deformed during the double-seaming closing operation. This in turn forms an inwardly extending projection for engaging and maintaining the end in a slightly raised relationship on the flanged outer end portion of the container when the end is positioned on the container for closing and prior to completion of the double-seaming operation so that the evacuation and back-flushing of gases out of and into the container can be performed with devices on the conventional container closing apparatus and just prior to hermetic sealing of the container.

Due in large part to manufacturing and shipping costs considerations and costs of materials, the container industry has been moving away from the use of metal containers and towards the use of plastic or preferably composite containers, i.e. container bodies fabricated from coated or uncoated fibrous material or composite multiple layers of fibrous material together with other compatible layers of materials such as plastic and/or foil liners, etc. The use of composite materials for the container have created additional problems or enhanced current problems with the evacuating and back-flushing of gases out of and into the container during the closing operation. For example, premature sealing of the flanged upper end of the composite container with the metal end through the sealing compound occurs due to the lack of stiffness in the composite container, as compared to a metal container, at the area in which the "stand-off beads" on the crown seaming panel of the metal end engage the flanged upper end portion of the composite container. Also, it has been found that the composite containers suffered from a condition described as "necking-in" which occurs when the inside diameter of the composite container is reduced due to the evacuating and back-flushing of gases and the closing of the metal end on the composite container with the double-seaming operation. This process can push the metal end into the flanged area of the container body plugging up the opening into the container. Metal container bodywalls are stronger and usually prevent this necking-in condition.

OBJECT AND SUMMARY OF THE INVENTION

Accordingly, it is an object of this invention to provide a generally cylindrical container and a generally circular end adapted for closing and sealing the container with sealing compound and a double-seaming operation and which is adapted for overcoming prior problems and permit superior evacuating and back-flushing of gases out of and into the container while the end is in a seated and unseamed position on the container during the closing operation.

By this invention, it has been found that the above object may be accomplished by providing an end which includes a central circular panel, a chuck wall surrounding an outer periphery of the central panel and extending radially outwardly and upwardly from the central panel and a crown seaming panel surrounding the chuck wall and extending radially outwardly from the chuck wall and having an outer curled end. The chuck wall and the crown seaming panel preferably have sealing compound on a portion of their inner surfaces and are the portions which are double-seamed with the flanged outer end portion of the container.

Separate projections are formed in the chuck wall and in the crown seaming panel and extend inwardly and radially of the chuck wall and the crown seaming panel, respectively. These projections are spaced around the chuck wall and around the crown seaming panel and are adapted to engage the flanged upper end of the container being closed for forming gas channels between the respective projections and between the flanged upper end of the container and the chuck wall and the crown seaming panel of the end when the end is in a seated and unseamed position on the container during the double-seaming closing operation.

Preferably, the projections alternate in spacing between the chuck wall and the crown seaming panel around the end. It is also preferable that the gas channel-forming projections in one of the chuck walls or crown seaming panel comprise pairs of closely spaced projections in which the pairs of projections are equally spaced around the end. It is also preferable that the gas channel-forming projections in one, preferably the other, of the chuck wall and the crown seaming panel comprise single projections equally spaced around the end. It has also been found particularly preferable to position the pairs of projections in the chuck wall and to position the single projections in the crown seaming panel.

While this invention is particularly adapted for use with a metal end double-seamed on and closing a composite container, it is also applicable for use with an end constructed of either metal or plastic and a container constructed of metal, plastic or composites.

BRIEF DESCRIPTION OF THE DRAWINGS

Some of the objects and advantages of this invention have been set forth above, other objects and advantages will appear in the Detailed Description Of The Preferred Embodiment Of The Invention to follow, when taken in conjunction with the accompanying drawings in which.

DETAILED DESCRIPTION OF THE PREFERRED EMBODIMENT OF THE INVENTION

Figure 1:
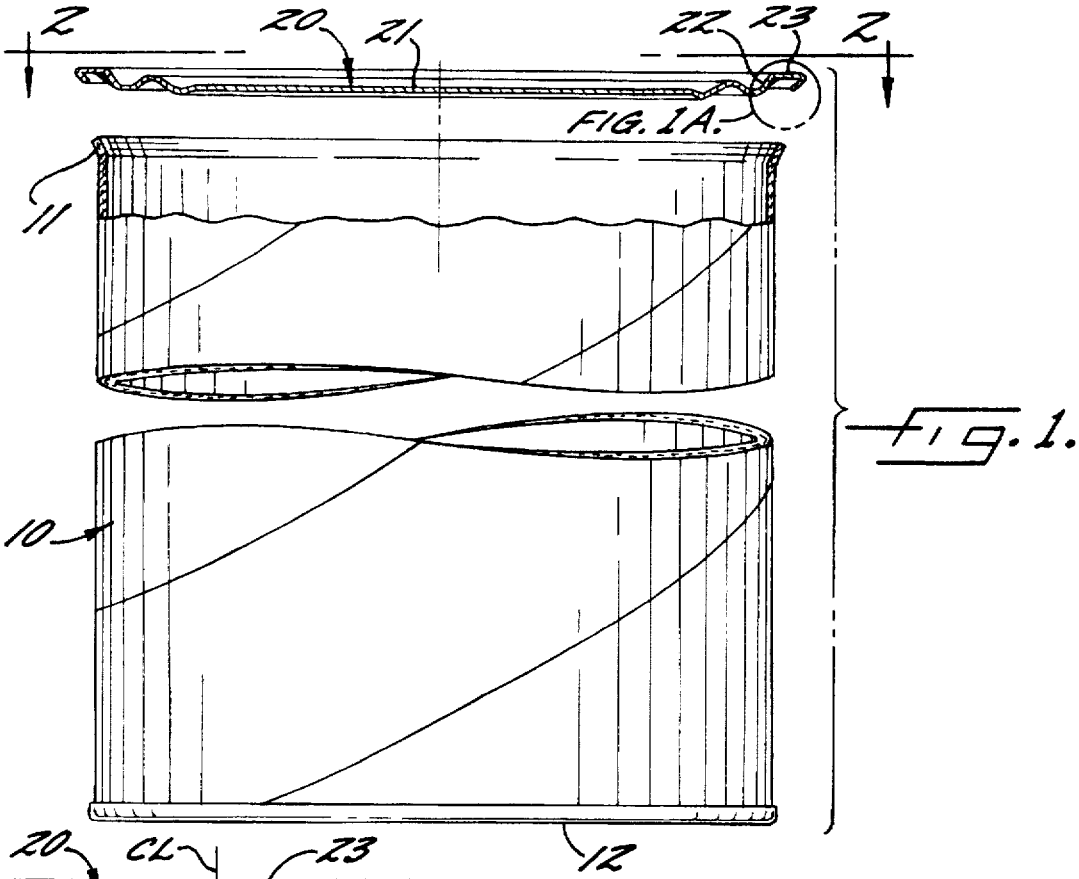
FIG. 1 is an exploded side elevational view, cut away, of a container and end closure (shown in section) constructed in accordance with this invention.

Referring now to the drawings, a generally cylindrical container 10 and a generally circular end 20 constructed in accordance with this invention are illustrated in exploded condition in FIG. 1 with the container 10 being broken away to conserve space. The generally cylindrical container 10 includes an outwardly-flanged upper end portion 11 for being double-seamed with the end 20 to close the container 10 in a manner to be described more fully below. The bottom 12 of the container 10 may be closed in any conventional manner or may include an end 20 of the type to be described more specifically below. The container 10 may be constructed of metal or plastic, but preferably is constructed of composites. Composites are well known in the container industry and may include multiple layers of various materials which may be spirally wound, convolutely wound or otherwise formed into a cylindrical container. These composite materials and their manufacture into a cylindrical container are well known by those with ordinary skill in the art and further explanation herein is not deemed necessary.

Figure 1A:
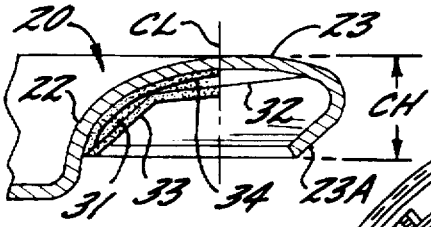
FIG. 1A is an enlarged sectional view of a portion of the end closure as shown in FIG. 1 and taken within the circle indicated in FIG. 1.

The end 20 used for closing of the container 10 by a double-seaming operation includes a central circular panel 21 and a chuck wall 22 surrounding an outer periphery of the central panel 21 and extending radially outwardly and upwardly from the central panel 21. The end 20 further includes a crown seaming panel 23 surrounding the chuck wall 22 and extending radially outwardly from the chuck wall and having an outer curled end 23A. Sealing compound 33, 34 (to be discussed in more detail below) is preferably positioned on an inside surface of a portion of the chuck wall 22 and a portion of the crown seaming panel 23. Preferably, the compound 33, 34 does not extend past the center line CL of the crown seaming panel and does not extend down the chuck wall past the curl height CH of the outer curled end 23A, as shown in FIG. 1A. This sealing compound 33, 34 may comprise any suitable sealing compounds including synthetic rubbers, etc. The chuck wall 22 and crown seaming panel 23 with curled outer end 23A are utilized to be double-seamed with the flanged outer end portion 11 of the container 10 during the double-seaming operation, as shown schematically in FIGS. 9A–9E wherein these components are deformed and bent in sequence to form the ultimate double-seam by conventional container closing apparatus (also schematically shown) in a manner well understood by those with ordinary skill in the art.

Figure 2:
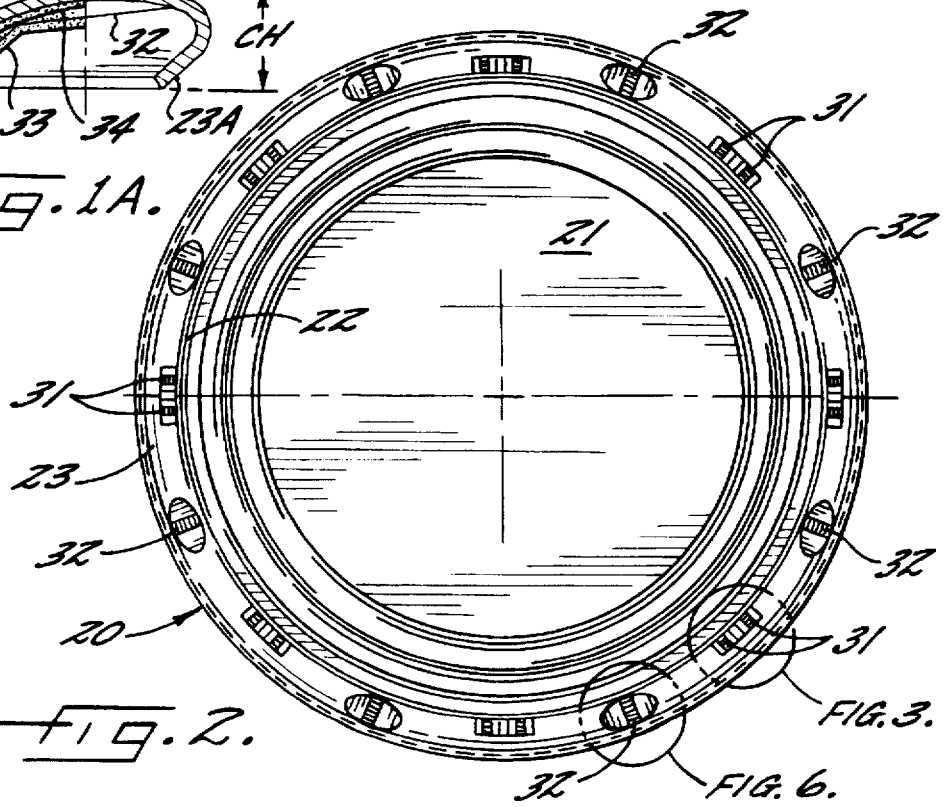
FIG. 2 is a top plan view, taken generally along the line 2—2 of FIG. 1, of the end closure.
Figure 3:
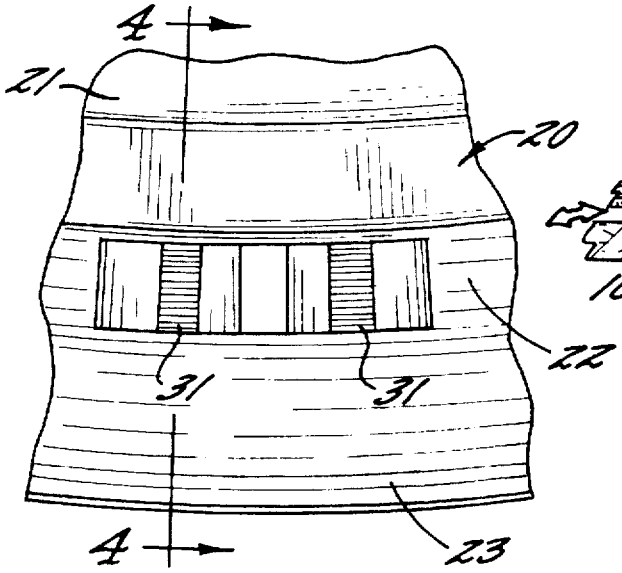
FIG. 3 is an enlarged partial top plan view of an area, as shown in the circle in FIG. 2, of the chuck wall of the end closure having a pair of projections therein for forming gas channels.
Figure 5:
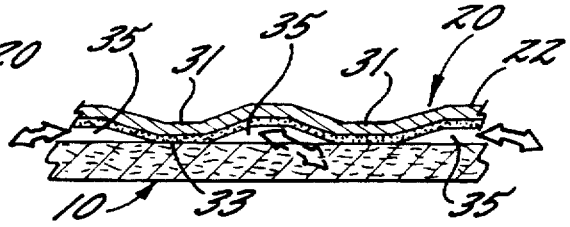
FIG. 5 is a sectional view, taken generally along the line 5—5 of FIG. 4.
Figure 4:
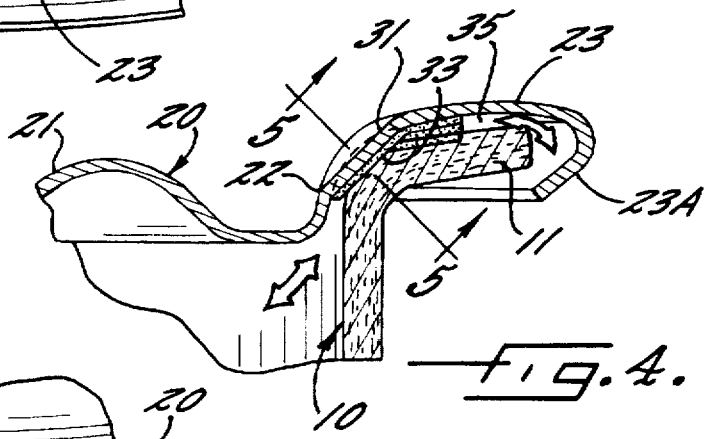
FIG. 4 is an enlarged sectional view, taken generally along the line 4—4 of FIG. 3.
Figure 6:
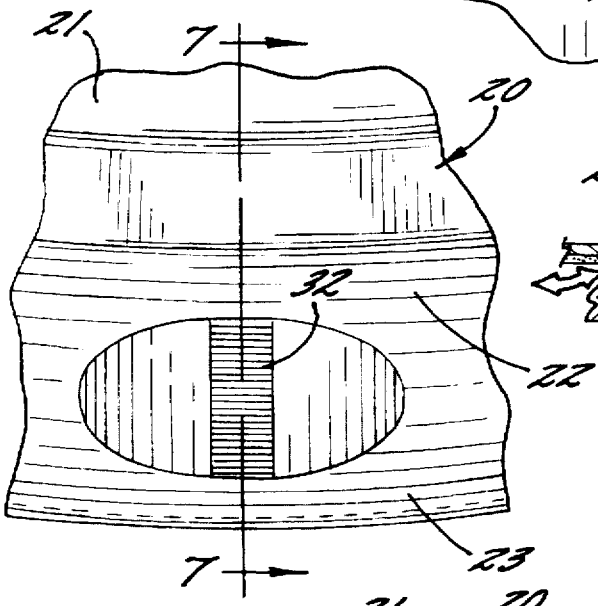
FIG. 6 is an enlarged partial top plan view of an area, as shown in the circle in FIG. 2, of the crown seaming panel of the end closure having a single projection therein for forming gas channels.
Figure 8:
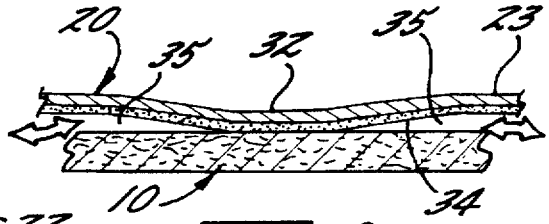
FIG. 8 is a section view, taken generally along the line 8—8 of FIG. 7.
Figure 7:
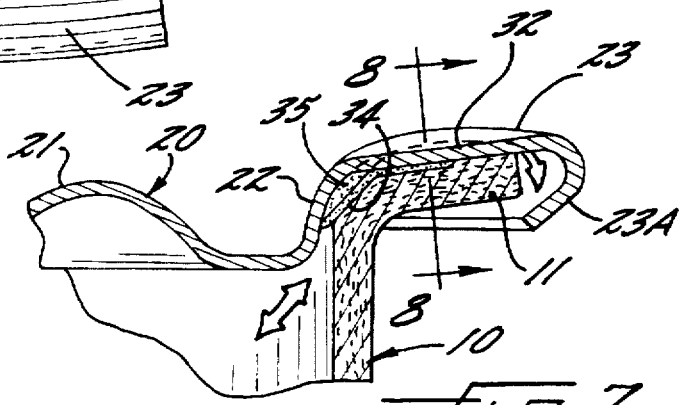
FIG. 7 is an enlarged sectional view, taken generally along the line 7—7 of FIG. 6.

Separate projections 31, 32 are formed in the chuck wall 22 and in the crown seaming panel 23 and extend inwardly and radially of the chuck wall 22 and crown seaming panel 23, respectively, and are spaced around the chuck wall 22 and crown seaming panel 23, as shown particularly in FIG. 2. Chuck wall projections 31 include compound 33 and crown seaming panel projections 32 include compound 34 on their respective inside surfaces. These projections 31, 32 engage the flanged upper end 11 of the container 10 being closed for forming gas channels 35 between respective projections 31, 32 and the sealing compound 33, 34 and between the flanged upper end portion 11 of the container 10 and the chuck wall 22 and the crown seaming panel 23 of the end 20 when the end 20 is in a seated and unseamed position on the container 10 during closing, as shown in FIGS. 3–8 and in FIGS. 9A–9E.

The size and shape, along with the number, of projections 31, 32 and resulting gas channels 35 utilized on each end 20 and the placement thereof in the chuck wall 22 and crown seaming panel 23 may vary due to the diameter of the end 20, the thickness of the material forming the end 20, countersink depth or other constructional features. However, it has been found preferred to alternate the projections 31, 32 in their spacing between the chuck 22 and crown seaming panel 23 around the end 20, as shown particularly in FIG. 2. It has also been found preferable that the channel forming projections 31, 32 in one of the chuck wall 22 or crown seaming panel 23 comprise pairs of closely spaced projections and in which said pairs of projections are equally spaced around the end. It has also been found preferable that the channel forming projections 31, 32 in one of the chuck wall 22 or crown seaming panel 23 comprise single projections equally spaced around the end 20. It has been found further desirable that the projections 31 in the chuck wall 22 comprise the pairs of closely spaced projections which are equally spaced around the end 21 and wherein the gas channel-forming projections 32 in the crown seaming panel 23 comprise the single projections equally spaced around the end 20 and wherein the pairs of projections 31 in the chuck wall 22 alternate in spacing with the single projections 32 in the crown seaming panel 23, as shown in FIG. 2. For a 4 1/16 inch diameter end 20 (commonly referred to in the industry as a "401 diameter end") illustrated in the drawings, it has been found preferable to utilize eight pairs of closely spaced projections 31 equally spaced around the end 20 and alternating with eight single projections 32 on the crown seaming panel 23 and equally spaced around the end 21.

Figure 9A:
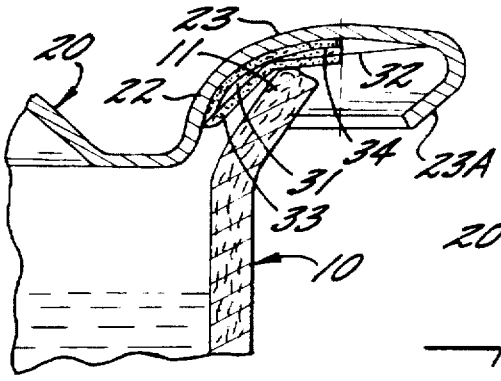
FIGS. 9A–E are sequential sectional views, like FIGS. 4 and 7, illustrating the sequential steps involved in closing of the flanged end of a container with an end using a double-seaming operation and while evacuating and back-flushing of gases from and into the container during such closing operation.
Figure 9B:
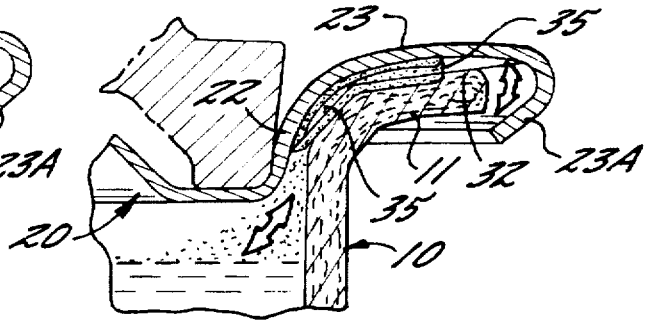
Figure 9C:
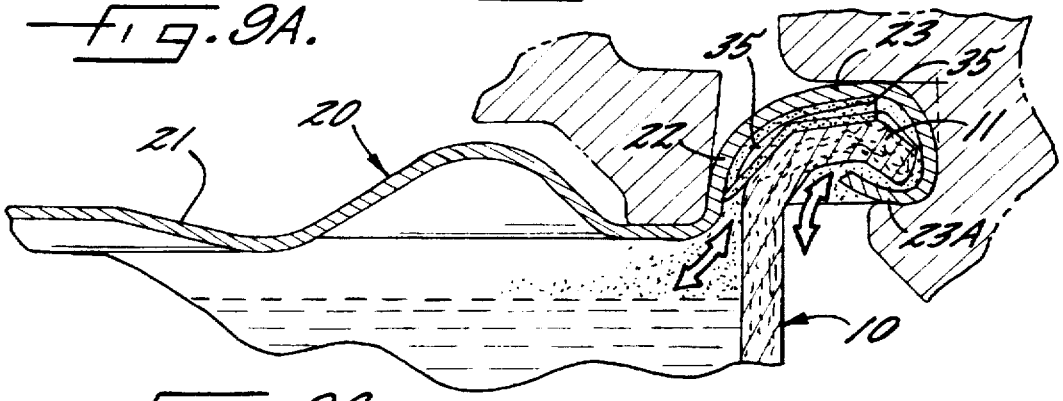
Figure 9D:
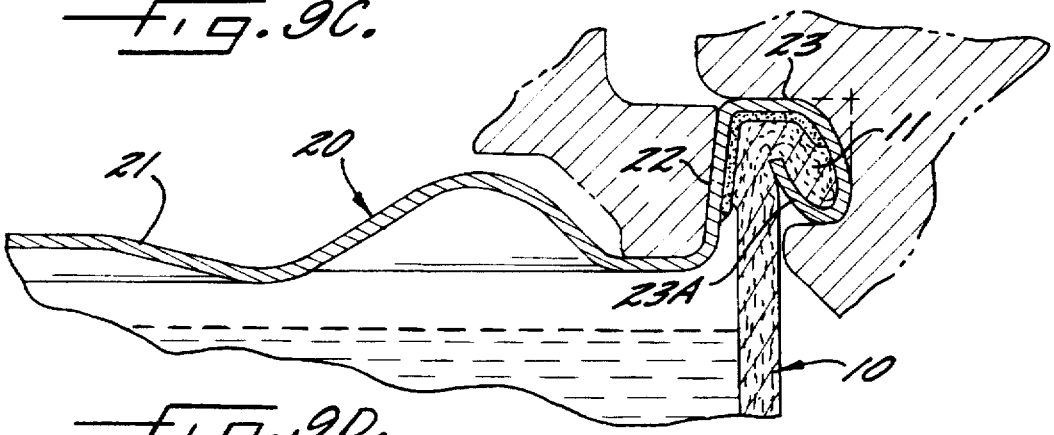
Figure 9E:
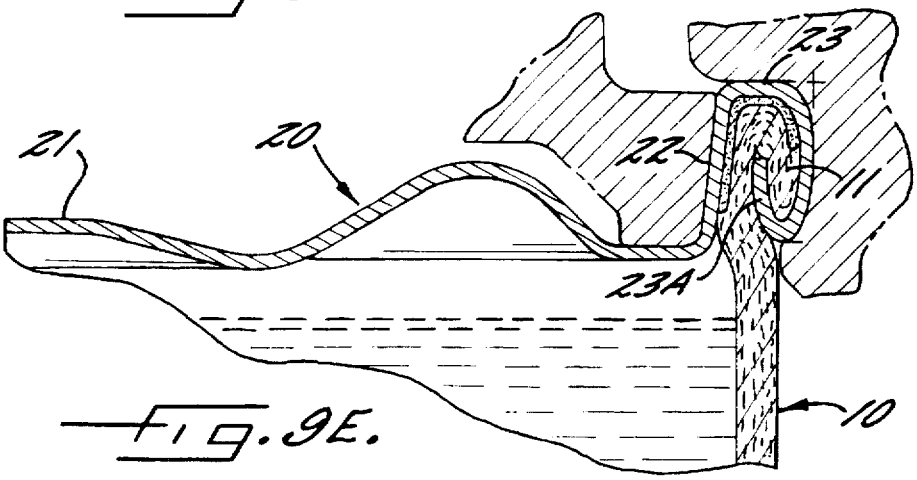

With this arrangement of alternating projections 31, 32 between the chuck wall 22 and the crown seaming panel 23, sufficient gas forming channels 35 are provided between such projections and between the chuck wall 22 and crown seaming panel 23 and flanged outer end portion 11 of container 10 and the sealing compound 33, 34 therebetween, when the end 20 is in a seated and unseamed position on the container 10 during closing, as shown in FIGS. 3–8 and as shown in FIGS. 9A–9C. Gases may be evacuated out of the container 10 and then gases may be back-flushed into the container 10 during the double-seaming closing operation, as shown schematically in FIGS. 9A–9E. This preferred arrangement of projections 31, 32 forming gas channels 35 has been found to satisfactorily allow this gas evacuating and back-flushing operation during the double-seaming closing operation when utilizing a container 10 constructed of composites and an end 20 constructed of metal; however, it will also perform satisfactorily with a container 10 constructed of metal, plastic or composites and an end 20 constructed of metal or plastic.

In the drawings and specification, there have been set forth preferred embodiments of this invention and although specific terms are employed, they are used in a generic and descriptive sense only and not for purposes of limitation. The scope of the invention is defined in the following claims.

What is claimed is:

1. A generally circular end adapted for use in closing and sealing an outwardly-flanged open upper end of a cylindrical container with a double seaming operation and adapted for permitting evacuating and back-flushing of gases out of and into the container while said end is in a seated and unseamed position on the container during the closing operation; said end comprising:

a central circular panel;

a chuck wall surrounding an outer periphery of said central panel and extending radially outwardly and upwardly from said central panel;

a crown seaming panel surrounding said chuck wall and extending radially outwardly from said chuck wall and having an outer curled end;

pairs of closely spaced adjacent projections formed in one of said chuck wall and said crown seaming panel and extending inwardly and radially thereof and being equally spaced around said end, single projections formed in the other of said chuck wall and said crown seaming panel and extending inwardly and radially thereof and being equally spaced around said end and in alternating position between said pairs of projections, the spacing between each of said adjacent projections in each of said pairs of projections being substantially less than the spacing between alternating pairs of projections and single projections, said pairs of projections and said single projections being adapted to engage the flanged upper end of the container being closed for forming gas channels between said respective projections and between the flanged upper end of the composite container and said chuck wall and said crown seaming panel of said end when said end is in a seated and unseamed position on the container during closing.

2. An end, as set forth in claim 1, wherein said pairs of closely spaced projections comprise 8 pairs of projections equally spaced around said end, and wherein said single projections comprise 8 single projections equally spaced around said end.

3. An end, as set forth in claim 1, wherein said end is constructed of a material selected from the group consisting of metal or plastic.

4. An end, as set forth in claim 1, wherein said end further includes sealing compound positioned on an inside surface of said chuck wall and said crown seaming panel.

5. An end, as set forth in claim 4, in which said sealing compound does not extend past a center line of said crown seaming panel and does not extend down said chuck wall more than a height of said outer curled end.

6. A generally circular metal end adapted for use in closing and sealing an outwardly-flanged open upper end of a cylindrical composite container with a double seaming operation and adapted for permitting evacuating and back-flushing of gases out of and into the container while said end is in a seated and unseamed position on the container during the closing operation; said metal end comprising:

a central circular panel;

a chuck wall surrounding an outer periphery of said central panel and extending radially outwardly and upwardly from said central panel;

a crown seaming panel surrounding said chuck wall and extending radially outwardly from said chuck wall and having an outer curled end;

sealing compound positioned on an inside surface of said chuck wall and said crown seaming panel and not extending past a center line of said crown seaming panel and not down said chuck wall more than a height of said outer curled end; and pairs of closely spaced adjacent projections formed in said chuck wall and extending inwardly and radially of said chuck wall and being equally spaced around said metal end, single projections formed in said crown seaming panel and extending inwardly and radially of said crown seaming panel and being equally spaced around said metal end and in alternating position between said pairs of projections in said chuck wall, the spacing between each of said adjacent projections in each of said pairs of projections being substantially less than the spacing between alternating pairs of projections and single projections, said pairs of projections in said chuck wall and said single projections in said crown seaming panel being adapted to engage the flanged upper end of the composite container being closed for forming gas channels between said respective projections and between the flanged upper end of the composite container and said chuck wall and said crown seaming panel of said metal end when said metal end is in a seated and unseamed position on the composite container during closing.

7. A combination container and end adapted for closing and sealing said container with a double seaming operation and adapted for permitting evacuating and back-flushing of gases out of and into said container while said end is in a seated and unseamed position on said container during the closing operation;

said container comprising a generally cylindrical container having an open outwardly-flanged upper end portion; and said end comprising a central circular panel, a chuck wall surrounding an outer periphery of said central panel and extending radially outwardly and upwardly from said central panel, a crown seaming panel surrounding said chuck wall and extending radially outwardly from said chuck wall and having an outer curled end, pairs of closely spaced adjacent projections formed in one of said chuck wall and said crown seaming panel and extending inwardly and radially thereof and being equally spaced around said end, single projections formed in the other of said chuck wall and said crown seaming panel and extending inwardly and radially thereof and being equally spaced around said end and in alternating position between said pairs of projections, the spacing between each of said adjacent projections in each of said pairs of projections being substantially less than the spacing between alternating pairs of projections and single projections, said pairs of projections and said single projections being adapted to engage the flanged upper end of the container being closed for forming gas channels between said respective projections and between the flanged upper end of the composite container and said chuck wall and said crown seaming panel of said end when said end is in a seated and unseamed position on the container during closing.

8. A combination container and end, as set forth in claim 7, wherein said container is constructed of a material selected from the group consisting of metal, plastic or composites, and wherein said end is constructed of a material selected from the group consisting of metal or plastic.

9. A combination container and end, as set forth in claim 7, wherein said end further includes sealing compound positioned on an inside surface of said chuck wall and said crown seaming panel.

10. A combination composite container and metal end adapted for closing and sealing said container with a double seaming operation and adapted for permitting evacuating and back-flushing of gases out of and into said container while said end is in a seated and unseamed position on said container during the closing operation;

said composite container comprising a generally cylindrical container having an open outwardly-flanged upper end portion; and said metal end comprising a central circular panel, a chuck wall surrounding an outer periphery of said central panel and extending radially outwardly and upwardly from said central panel, a crown seaming panel surrounding said chuck wall and extending radially outwardly from said chuck wall and having an outer curled end, sealing compound positioned on an inside surface of said chuck wall and said crown seaming panel and not extending past a center line of said crown seaming panel and not down said chuck wall more than a height of said outer curled end, pairs of closely spaced adjacent projections formed in said chuck wall and extending inwardly and radially of said chuck wall and being equally spaced around said metal end, single projections formed in said crown seaming panel and extending inwardly and radially of said crown seaming panel and being equally spaced around said metal end and in alternating position between said pairs of projections in said chuck wall, the spacing between each of said adjacent projections in each of said pairs of projections being substantially less than the spacing between alternating pairs of projections and single projections, said pairs of projections in said chuck wall and said single projections in said crown seaming panel being adapted to engage the flanged upper end of the composite container being closed for forming gas channels between said respective projections and between the flanged upper end of the composite container and said chuck wall and said crown seaming panel of said metal end when said metal end is in a seated and unseamed position on the composite container during closing.

* * * * *

UNITED STATES PATENT AND TRADEMARK OFFICE
CERTIFICATE OF CORRECTION

PATENT NO. : 5,788,112

DATED : August 4, 1998

INVENTOR(S) : Bacon et al.

It is certified that error appears in the above-identified patent and that said Letters Patent is hereby corrected as shown below:

On the title page, item [56],
In the References Cited, U.S. PATENT DOCUMENTS, please add the following references:

| | | |
|---|---|---|
| 3,086,869 | 4/23/63 | Seiferth et al. |
| 4,270,475 | 6/2/81 | Fletcher et al. |
| 4,428,741 | 1/31/84 | Westphal |

Signed and Sealed this

Fifth Day of January, 1999

*Attest:*

*Attesting Officer*

*Acting Commissioner of Patents and Trademarks*